US007216505B2

(12) United States Patent
Braz

(10) Patent No.: US 7,216,505 B2
(45) Date of Patent: May 15, 2007

(54) MULTIPLE STAGE RECIRCULATING SINGLE FEED REFRIGERATION SYSTEM WITH AUTOMATIC PUMP DOWN

(75) Inventor: Marcos R. Braz, College Station, TX (US)

(73) Assignee: Carter & Burgess, Inc., Fort Worth, TX (US)

( * ) Notice: Subject to any disclaimer, the term of this patent is extended or adjusted under 35 U.S.C. 154(b) by 463 days.

(21) Appl. No.: 10/926,936

(22) Filed: Aug. 26, 2004

(65) Prior Publication Data

US 2005/0044880 A1 Mar. 3, 2005

Related U.S. Application Data

(60) Provisional application No. 60/497,885, filed on Aug. 26, 2003.

(51) Int. Cl.
*F25B 41/04* (2006.01)
*F25B 1/00* (2006.01)
*F25B 1/10* (2006.01)

(52) U.S. Cl. ..... 62/498; 62/510; 62/85

(58) Field of Classification Search ..... 62/498, 62/510, 85, 513, 509, 512
See application file for complete search history.

(56) References Cited

U.S. PATENT DOCUMENTS 5,103,650 A * 4/1992 Jaster ..... 62/198
5,157,931 A * 10/1992 Alsenz ..... 62/116

OTHER PUBLICATIONS

Letter from Anthony Jaecques of Carter & Burgess to Wal-Mart Stores re providing a refrigeration system, dated Nov. 17, 2000, w/attached building design task order (193 pages).

* cited by examiner

*Primary Examiner*—Chen Wen Jiang
(74) *Attorney, Agent, or Firm*—Winstead PC; Henry L Ehrlich

(57) ABSTRACT

A method and apparatus for a recirculating system with single feed that incorporates a liquid transfer vessel that helps prevent the vessels in the system from flooding, provides easy displacement of liquid refrigerant from the flooded vessels while economizing refrigerant liquid lines with insulation, pumps, and valves in the refrigeration system.

15 Claims, 2 Drawing Sheets

MULTIPLE STAGE RECIRCULATING SINGLE FEED REFRIGERATION SYSTEM WITH AUTOMATIC PUMP DOWN

RELATED APPLICATIONS

This application claims benefit of priority from U.S. Provisional Application No. 60/497,885, filed Aug. 26, 2003 and entitled MULTIPLE STAGE RECIRCULATING SINGLE FEED REFRIGERATION SYSTEM WITH AUTOMATIC PUMP DOWN, which is incorporated herein by reference.

FIELD OF THE INVENTION

The present invention relates to refrigeration systems, and more specifically, a refrigeration system having a single feed that incorporates a liquid transfer vessel that alleviates vessels in the system from flooding, provides easy displacement of liquid refrigerant from the flooded vessels and economizes liquid refrigerant lines and reduces the total system power (BHP) requirement.

BACKGROUND

One of the common events during the start up of a refrigeration facility is the failure of control valves. These failures are usually associated with the amount of dirt collected during construction and before the first operation of the control valves. The end result is the flooding of the recirculator's vessels. When a recirculator vessel is flooded a series of events are initiated, that are potentially dangerous to the plant safety and performance, such as compressor failure due to a liquid "slug," relief of liquid refrigerant through relief lines vented to the atmosphere, overpressurizing of flanged and sealed lines; and excessive amount of time to return to operational conditions since the liquid refrigerant has to be evaporated and compressed to return to the high side of the system.

It is a therefore a desire to provide a recirculating system with single feed that decreases flash vapor at closer lower temperature recirculators, incorporates a liquid transfer vessel that helps prevent the vessels in the system from flooding, provides easy displacement of liquid refrigerant from the flooded vessels while economizing refrigerant liquid lines with insulation, pumps, and valves in the refrigeration system.

SUMMARY OF THE INVENTION

The efficiency (BHP/TR) in a refrigeration system is gained by reducing the amount of Brake Horsepower (BHP) required to produce a Ton of Refrigeration (TR). Efficiency is gained by supplying liquid refrigerant to the evaporators while minimizing the amount of flash vapor due to the throttling of saturated liquid refrigerant feeding the evaporator at its level of pressure/temperature. At lower temperature/pressure stages in a typical refrigeration system the difference in pressure and respective temperature is minimal, in the order of 2 psig to 5 psig, between stages. Therefore it is typical that the refrigerant liquid feed for the lower temperature/pressure stages would come from a higher pressure/temperature level, increasing the amount of flash vapor while decreasing the efficiency (BHP/TR). The single liquid refrigerant feed for the lower temperature/pressure level(s) is made directly to the evaporators at the lower temperature/pressure stage through the refrigerant centrifugal pump(s). That allows lowering the amount of flash vapor and increasing the energy efficiency by lowering BHP/TR.

The initial cost of an industrial refrigeration system is substantial, especially when several levels of temperature have to be maintained in a building. Common temperature levels are 55 degrees, 34 degrees, −10 degrees, −20 degrees and −40 degrees Fahrenheit. It is common to combine the different temperature/pressure on a single temperature/pressure stage to save initial costs on equipment installed. However, by doing so the energy requirements increase on the system. The present invention increases the efficiency of the system and at the same time decreases the amount of liquid lines, refrigerant pumps, and valves with less BHP consumed per TR There are additional savings in operational costs associated with maintenance required on fewer moving parts in the system.

Accordingly, a multiple stage recirculating single feed refrigeration system with automatic pump down and method are provided. A multiple stage recirculated single feed refrigeration system of the present invention includes a first high stage compressor for compressing vapor refrigerant from a first evaporator via a first recirculator; a condenser for receiving hot vapor refrigerant from the first compressor and condensing the hot vapor refrigerant to a liquid refrigerant; a high pressure receiver for feeding high pressure liquid refrigerant to the first recirculator; a second compressor for compressing vapor refrigerant from a second evaporator via a second recirculator and wherein the second recirculator is fed by liquid refrigerant from the first recirculator and the second evaporator is fed by the second recirculator; a third compressor for compressing vapor refrigerant from a third evaporator via a separator vessel wherein the third evaporator is fed by the second recirculator wherein excess liquid refrigerant is transferred to a separator vessel; a liquid transfer vessel for receiving excess liquid refrigerant from the separator vessel; a motorized valve in connection between the separator vessel and the liquid transfer vessel for controlling flow of the liquid refrigerant to the liquid transfer vessel; and a refrigerant liquid pump for transferring excess liquid refrigerant from the liquid transfer vessel to the second recirculator and for transferring liquid refrigerant to the high pressure receiver.

A multiple stage recirculated single feed refrigeration method of the present invention includes the steps of compressing a vapor refrigerant with a first compressor from a first evaporator via a first recirculator; condensing the hot vapor from the first compressor to a liquid refrigerant; feeding the liquid refrigerant from a high pressure receiver to the first recirculator; feeding the liquid refrigerant from the first recirculator to a second recirculator; feeding a second evaporator liquid refrigerant from the second recirculator; compressing vapor refrigerant from the second evaporator into the first receiver; feeding a third evaporator liquid refrigerant from the second recirculator; transferring overfed liquid refrigerant to the third evaporator to a separator vessel; compressing vapor refrigerant from the third evaporator into the first recirculator; flowing liquid refrigerant from the separator vessel to a liquid transfer vessel; pumping the excess liquid from the liquid transfer vessel to the second recirculator; closing flow of liquid refrigerant from the separator vessel to the liquid transfer vessel when the liquid refrigerant in the liquid transfer level attains a predetermined depth; closing an equalization line between the separator vessel and the liquid transfer vessel; opening an equalization line between the liquid transfer vessel and the high pressure receiver; pumping liquid refrigerant from the liquid transfer vessel to the high pressure receiver until the liquid refrigerant level in the liquid transfer vessel drops below the predetermined depth; closing the equalization line between the liquid transfer vessel and the high pressure receiver; opening the equalization line between the separator vessel and the liquid transfer vessel; opening flow of the liquid refrigerant from the separator vessel to the liquid transfer vessel; and pumping excess liquid refrigerant from the liquid transfer vessel to the second recirculator.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
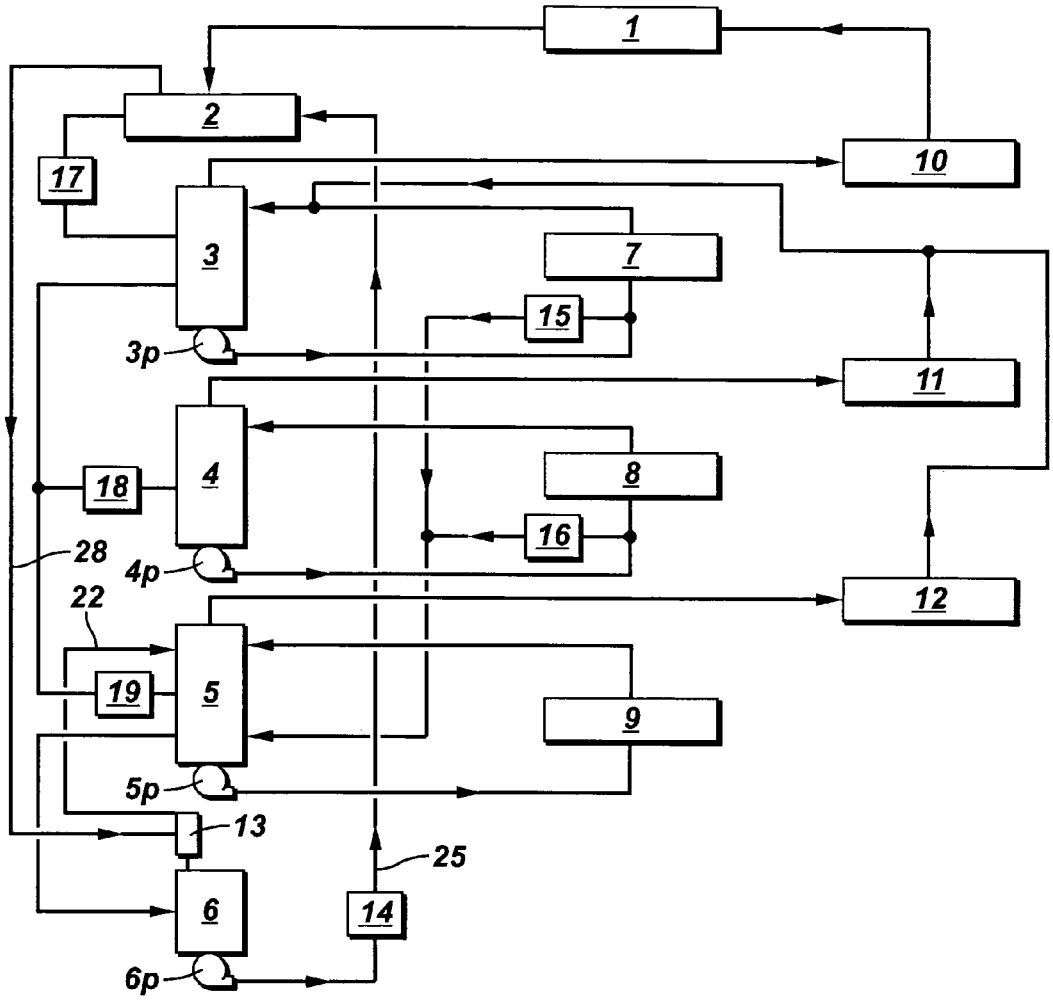
FIG. 1 (Prior Art)
FIG. 1 is a schematic drawing of a prior art system.

Refer now to the drawings wherein depicted elements are not necessarily shown to scale and wherein like or similar elements are designated by the same reference numeral through the several views.

FIG. 1 is a schematic drawing of a typical prior art recirculated refrigeration system with multiple stages of temperature/pressure stages. The high stage compressor(s) 10 receive the vapor refrigerant from evaporator 7 separated from liquid refrigerant at recirculator 3, compresses the vapor refrigerant and sends it to the evaporative condenser 1 where the vapor refrigerant changes phases and is transformed into liquid refrigerant at high pressure. The liquid refrigerant flows by gravity to the high pressure receiver 2. From there the high pressure liquid refrigerant feeds recirculator 3, through control valve 17. After the established liquid refrigerant level is satisfied at recirculator 3, liquid refrigerant passes through centrifugal or positive displacement pump(s) 3*p* to evaporator(s) 7. The liquid refrigerant feed line coming from pump 3*p* at the recirculator 3 also has the capability of sending liquid refrigerant to recirculator 5 when the liquid refrigerant level at recirculator 3 is higher than desired. A control system is activated by level sensors installed at recirculator 3 and sends signal to solenoid control valve 15 installed between the pumps and evaporator to open or close as required to transfer liquid refrigerant from recirculator 3 to recirculator 5. As shown in FIG. 1, compressor 11 receives the vapor refrigerant from evaporator 8 separated from liquid refrigerant at recirculator 4 and compressor 12 receives the vapor refrigerant from evaporator 9 separated from liquid refrigerant at recirculator 5.

Recirculator 4 is fed by refrigerant liquid refrigerant stored at recirculator 3 through control valve 18. After the established liquid refrigerant level is satisfied at recirculator 4 the liquid refrigerant passes through pumps 4*p* to evaporators 8. The liquid refrigerant feed line coming from pump 4*p* at the recirculator 4 also has the capability of sending liquid refrigerant to recirculator 5 when the liquid refrigerant level at the recirculator 4 is higher than desired. The control system is activated by level sensors installed between pumps and evaporator to open or close as required to transfer liquid refrigerant from recirculator 4 to recirculator 5.

Recirculator 5 is fed by refrigerant liquid refrigerant stored at recirculator 5 through control valve 19. After the established liquid refrigerant level is satisfied at recirculator 5 the liquid refrigerant passes through pumps 5*p* to evaporators 9. The recirculator 5 receives excess liquid refrigerant from recirculators 3 and 4 as described above. When the liquid refrigerant level at recirculator 5 is higher than desired, the refrigerant liquid refrigerant flows to liquid refrigerant transfer vessel 6 by gravity. Liquid transfer vessel 6 is equalized with recirculator 5 by control valve 13 so that the liquid transfer vessel 6 continues to fill up to a determined set level. At this set point of liquid refrigerant level control valve 13 closes the equalization line 22 to recirculator 5 and opens the equalization line to the high pressure receiver. After a time delay the refrigerant liquid pumps 6*p* starts to send liquid refrigerant to the high pressure receiver 2. After the level on the liquid transfer vessel 6 is lowered to a predetermined set point, control valve 13 closes the equalization to the high pressure receiver 2 and opens the equalization line to recirculator 5. The cycle will be repeated as required depending of the liquid refrigerant level at recirculator 5. Other valves such as check valves and shut off valves are used to keep the pressures separated at each level of the recirculators and are commonly used on this type of system.

Figure 2:
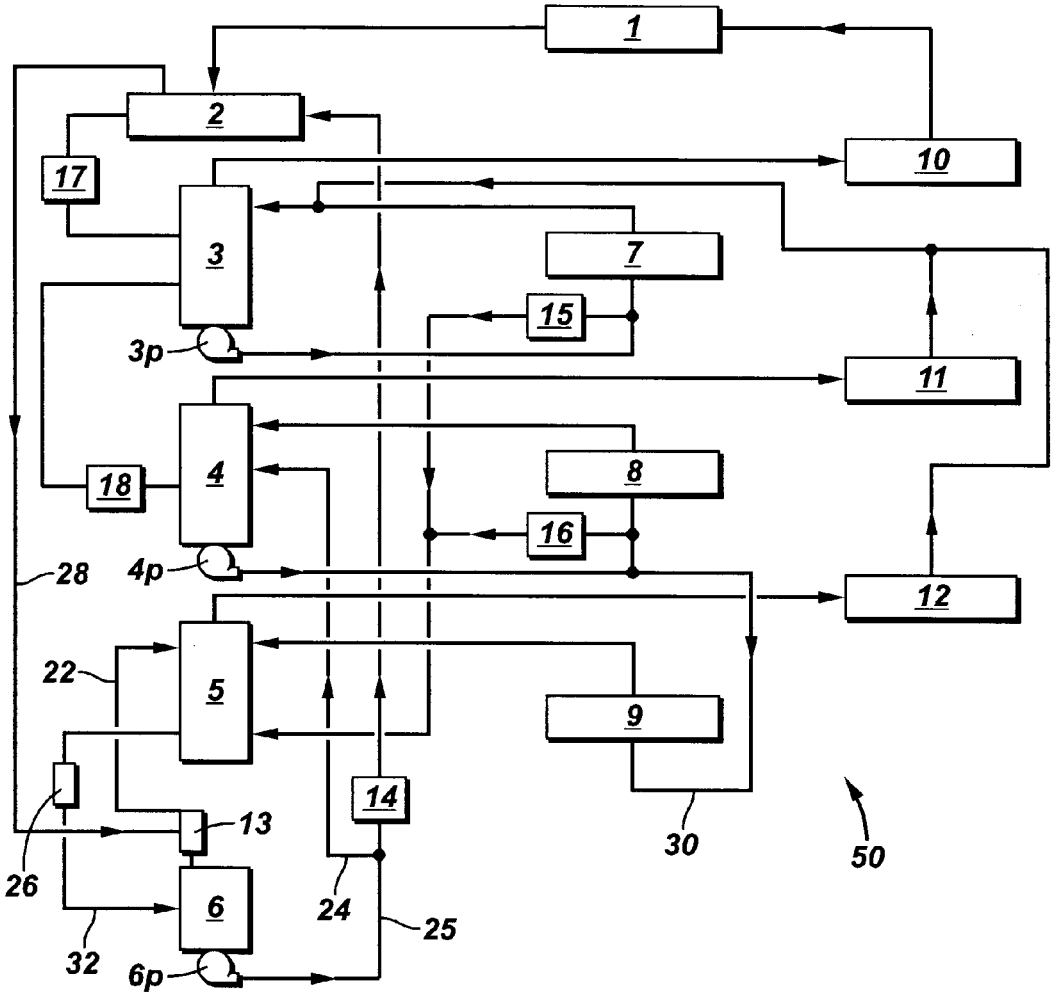
FIG. 2 is a schematic drawing of the present invention.

FIG. 2 is a schematic drawing of the refrigeration system of the present invention designated generally by the numeral 50. In the present invention evaporator 9 is fed by recirculator 4 pumps 4*p* via a feed line 30 eliminating the need for pumps 5*p* of the prior art systems. The liquid refrigerant feed control valve at recirculator 5 is eliminated. The amount of flash vapor at recirculator 5 is reduced since the evaporators 9 are fed by recirculator 4 instead of recirculator 3 which is at a higher temperature. The overfed liquid refrigerant to evaporators 9 is returned to separator vessel 5 and transferred by gravity to the liquid transfer vessel 6. The refrigerant liquid pumps 6*p* then send the excess liquid recirculated back to recirculator vessel 4. This is achieved through bypass line 24 by a control valve 14 installed at the high pressure receiver liquid refrigerant return line 25 that stays closed due to the pressure differential. This feature improves BHP/TR efficiency for the multiple stage system and reduces the number of pumps installed.

Liquid transfer vessel 6 is connected through a motorized valve 26 to separator vessel 5. Valve 26 is normally open. As soon as the liquid refrigerant level at the separator vessel reaches a level higher than desired, detected by a level sensor controlled by the computer control system, the motorized globe valve 26 closes, the control valve 13 closes the equalization line 22 to separator vessel 5 and opens the equalization line 28 to high pressure receiver 2. After a time delay the refrigerant liquid pumps 6*p* starts to send liquid refrigerant to the high pressure receiver 2. After the level on the liquid transfer vessel 6 is lowered to a predetermined set point, control valve 13 closes the equalization line 28 to the high pressure receiver 2, opens the equalization line 22 to recirculator 5 and opens motorized valve 26. Other valves such as check valves and shut-off valves are used to keep the pressures separated at each level of the recirculators.

The sizing of the liquid transfer vessel is proportional to the amount of returning from the system during normal operation as well as the emergency high liquid refrigerant level on recirculators 3 and 4. The line 32 for motorized valve 26 should be sized for very low pressure drop, preferably less than 0.1 psi/100 ft, and the motorized valve 26 should be full port ball valve and follow the line size dimension. The motorized ball valve should have the port vented upstream to avoid liquid refrigerant trapped within the valve. A butterfly motorized valve may be used.

The refrigerant liquid pumps of recirculator 4 have to be sized for the overfeed ratio and capacity required by evaporators 8 and 9.

Liquid transfer vessel 6 preferably needs to be sized for two refrigerant liquid pumps including a standby pump. Refrigerant liquid pumps 6*p* desirably are sized for a liquid refrigerant overfeed ratio smaller by one recirculation rate than the required overfeed ratio of evaporator 9. The refrigerant liquid pumps 6*p* desirably are sized for reduced pressure differential, 10 to 15 PSIG, since they have to return liquid only to recirculator vessel 4, eliminating the need to serve a much higher liquid refrigerant pressure drop, typically 40 to 60 PSIG, requirement of evaporators 9 of the prior art systems.

The amount flash vapor at evaporator 9 has to be considered when sizing the liquid refrigerant feed header at evaporators 9, normally 3 to 5 percent of vapor flash. The liquid refrigerant returned from liquid transfer vessel 6 by refrigerant liquid pumps 6*p*, coming from a lower temperature/pressure helps to subcool the liquid refrigerant recirculated at recirculator vessel 4 decreasing the vapor flash during normal operation helping the refrigerant liquid pumps 4*p* to avoid cavitation. Thereby increasing their useful life and decreasing vapor flash through the lines translates into more efficient liquid refrigerant distribution to evaporators 8 and 9.

From the foregoing detailed description of specific embodiments of the invention, it should be apparent that a multiple stage recirculated single feed refrigeration system with automatic pump down that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A multiple stage recirculated single feed refrigeration system, the system comprising:

a first high stage compressor for compressing vapor refrigerant from a first evaporator via a first recirculator;

a condenser for receiving hot vapor refrigerant from the first compressor and condensing the hot vapor refrigerant to a liquid refrigerant;

a high pressure receiver for feeding high pressure liquid refrigerant to the first recirculator;

a second compressor for compressing vapor refrigerant from a second evaporator via a second recirculator and wherein the second recirculator is fed by liquid refrigerant from the first recirculator and the second evaporator is fed by the second recirculator;

a third compressor for compressing vapor refrigerant from a third evaporator via a separator vessel wherein the third evaporator is fed by the second recirculator wherein excess liquid refrigerant is transferred to the separator vessel;

a liquid transfer vessel for receiving excess liquid refrigerant from the separator vessel;

a motorized valve in connection between the separator vessel and the liquid transfer vessel for controlling flow of the liquid refrigerant to the liquid transfer vessel; and a refrigerant liquid pump for transferring excess liquid refrigerant from the liquid transfer vessel to the second recirculator and for transferring liquid refrigerant to the high pressure receiver.

2. The system of claim 1 wherein the motorized valve is a full port ball valve.

3. The system of claim 1 wherein the motorized valve is a butterfly valve.

4. The system of claim 1 wherein a line for the motorized valve is sized for a pressure drop of 0.1 psi per 100 feet or less.

5. The system of claim 1 wherein the refrigerant liquid pump is sized for a liquid refrigerant overfeed ratio smaller by one recirculation rate than the required overfeed ratio of the third evaporator.

6. The system of claim 5 wherein the refrigerant liquid pump includes more than one refrigerant liquid pump.

7. The system of claim 6 wherein a line for the motorized valve is sized for a pressure less of less than 0.1 psi per 100 feet.

8. The system of claim 5 wherein a line for the motorized valve is sized for a pressure less of less than 0.1 psi per 100 feet.

9. The system of claim 1 wherein the refrigerant liquid pump is sized for a liquid refrigerant differential pressure in the range of 10 to 15 psig.

10. The system of claim 9 wherein the refrigerant liquid pump includes more than one refrigerant liquid pump.

11. The system of claim 9 wherein a line for the motorized valve is sized for a pressure less of less than 0.1 psi per 100 feet.

12. A multiple stage recirculated single feed refrigeration method, the method comprising the steps of:

compressing a vapor refrigerant with a first compressor from a first evaporator via a first recirculator;

condensing the hot vapor from the first compressor to a liquid refrigerant;

feeding the liquid refrigerant from a high pressure receiver to the first recirculator;

feeding the liquid refrigerant from the first recirculator to a second recirculator;

feeding a second evaporator liquid refrigerant from the second recirculator;

compressing vapor refrigerant from the second evaporator into the first receiver;

feeding a third evaporator liquid refrigerant from the second recirculator;

transferring overfed liquid refrigerant to the third evaporator to a separator vessel;

compressing vapor refrigerant from the third evaporator into the first recirculator;

flowing liquid refrigerant from the separator vessel to a liquid transfer vessel;

pumping the excess liquid from the liquid transfer vessel to the second recirculator;

closing flow of liquid refrigerant from the separator vessel to the liquid transfer vessel when the liquid refrigerant in the liquid transfer level attains a predetermined depth;

closing an equalization line between the separator vessel and the liquid transfer vessel;

opening an equalization line between the liquid transfer vessel and the high pressure receiver;

pumping liquid refrigerant from the liquid transfer vessel to the high pressure receiver until the liquid refrigerant level in the liquid transfer vessel drops below the predetermined depth;

closing the equalization line between the liquid transfer vessel and the high pressure receiver;

opening the equalization line between the separator vessel and the liquid transfer vessel;

opening flow of the liquid refrigerant from the separator vessel to the liquid transfer vessel; and pumping excess liquid refrigerant from the liquid transfer vessel to the second recirculator.

13. The method of claim 12 wherein flow of liquid refrigerant between the separator vessel and the liquid transfer vessel is a motorized valve.

14. The method of claim 13 wherein the motorized valve is a full bore ball valve.

15. The method of claim 13 wherein the motorized valve is a butterfly valve.

* * * * *